US006416161B1

(12) United States Patent
Berg et al.

(10) Patent No.: US 6,416,161 B1
(45) Date of Patent: Jul. 9, 2002

(54) WIPER BLADE MECHANISM FOR INK JET PRINTERS

(75) Inventors: Richard H. Berg, Rochester; Donald M. Stevens, Walworth, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/594,692

(22) Filed: Jun. 16, 2000

(51) Int. Cl.[7] ..... B41J 2/165
(52) U.S. Cl. ..... 347/33; 347/36
(58) Field of Search ..... 347/22, 23, 24, 347/29, 30, 31, 32, 33, 36

(56) References Cited

U.S. PATENT DOCUMENTS

| | | | | |
|---|---|---|---|---|
| 4,746,938 A | | 5/1988 | Yamamori et al. | 347/28 |
| 4,853,717 A | | 8/1989 | Harmon et al. | 347/29 |
| 4,855,764 A | | 8/1989 | Humbs et al. | 347/31 |
| 5,151,715 A | | 9/1992 | Ward et al. | 347/33 |
| 5,250,962 A | | 10/1993 | Fisher et al. | 347/32 |
| 5,339,102 A | | 8/1994 | Carlotta | 347/32 |
| 5,500,659 A | | 3/1996 | Curran, Jr. et al. | 347/28 |
| 5,548,310 A | | 8/1996 | Binnert et al. | 347/33 |
| 5,617,125 A | * | 4/1997 | Chew | 347/36 |
| 5,659,341 A | | 8/1997 | Kinas | 347/33 |
| 5,798,775 A | * | 8/1998 | Takahashi et al. | 347/33 |
| 5,821,955 A | * | 10/1998 | Waschhauser | 347/36 |
| 5,943,071 A | | 8/1999 | Premnath | 347/33 |
| 5,997,128 A | * | 12/1999 | Lou et al. | 347/33 |
| 6,102,518 A | * | 8/2000 | Taylor | 347/29 |
| 6,130,684 A | | 10/2000 | Premnath et al. | 347/30 |
| 6,139,129 A | * | 10/2000 | Tabasso et al. | 347/33 |
| 6,189,999 B1 | * | 2/2001 | Pham et al. | 347/33 |

FOREIGN PATENT DOCUMENTS

| | | | | |
|---|---|---|---|---|
| JP | 6-143597 A | * | 5/1994 | B41J/2/65 |

* cited by examiner

*Primary Examiner*—John Barlow
*Assistant Examiner*—Blaise L Mouttet
(74) *Attorney, Agent, or Firm*—Oliff & Berridge, PLC

(57) ABSTRACT

A method and system for a wiper blade mechanism usable in a maintenance station of an ink jet printer, including at least one printhead cap, a scraper, a cam shaft, a drive gear mechanism, at least one wiper blade, and a spittoon.

27 Claims, 14 Drawing Sheets

WIPER BLADE MECHANISM FOR INK JET PRINTERS

BACKGROUND OF THE INVENTION

1. Field of Invention

This invention relates to a maintenance stations for ink jet printing apparatus.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After significant amounts of printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

In one exemplary embodiment of the maintenance station according to this invention, one or more printheads are mounted on a translatable carriage and moves with the carriage. When the printer is printing, the translatable carriage is located in a printing zone, where the one or more printheads can eject ink onto a recording medium. When the printer is placed into a non-printing mode, the translatable carriage is translated to the maintenance station located outside and to one side of the printing zone. Once the cartridge is translated to the maintenance station, various maintenance functions can be performed on the one or more printheads of the printer depending on the rotational position of a cam shaft in the maintenance station. The cam shaft engages and drives the hardware that in turn operates the individual maintenance functions.

Rotating the cam shaft activates various maintenance mechanisms of the maintenance station, including a wiper blade platform and a cap carriage. The wiper platform passes across the printhead nozzle faces when the one or more printheads enter the maintenance station and again just before the one or more printheads leave. A location for collecting ink cleared from the nozzles is placed adjacent to the wiper blades. After the one or more printheads arrive at the maintenance station, a vacuum pump is energized, and the cap carriage is elevated to the position where the one or more printhead caps engage the one or more printheads. The one or more printhead caps are mounted on the cap carriage in a capping location. The printheads are primed when a pinch tube mechanism opens one or more pinch tubes connected to the one or more printhead caps. Opening the pinch tubes releases negative pressure created by the vacuum pump. In response, ink is drawn from the one or more printheads into the one or more printhead caps.

Further moving the cam shaft lowers the cap carriage and enables the wiper blades to pass back across the nozzle faces to clean the ink jet printhead nozzles. The vacuum pump is then deenergized, while the cap carriage remains in position so that the one or more printhead caps cap the one or more printheads awaiting the printing mode of the printer. Thus, the one or more printheads remain capped at the maintenance station until the printer is into the printing mode.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF PREFERRED EMBODIMENTS

Figure 1:
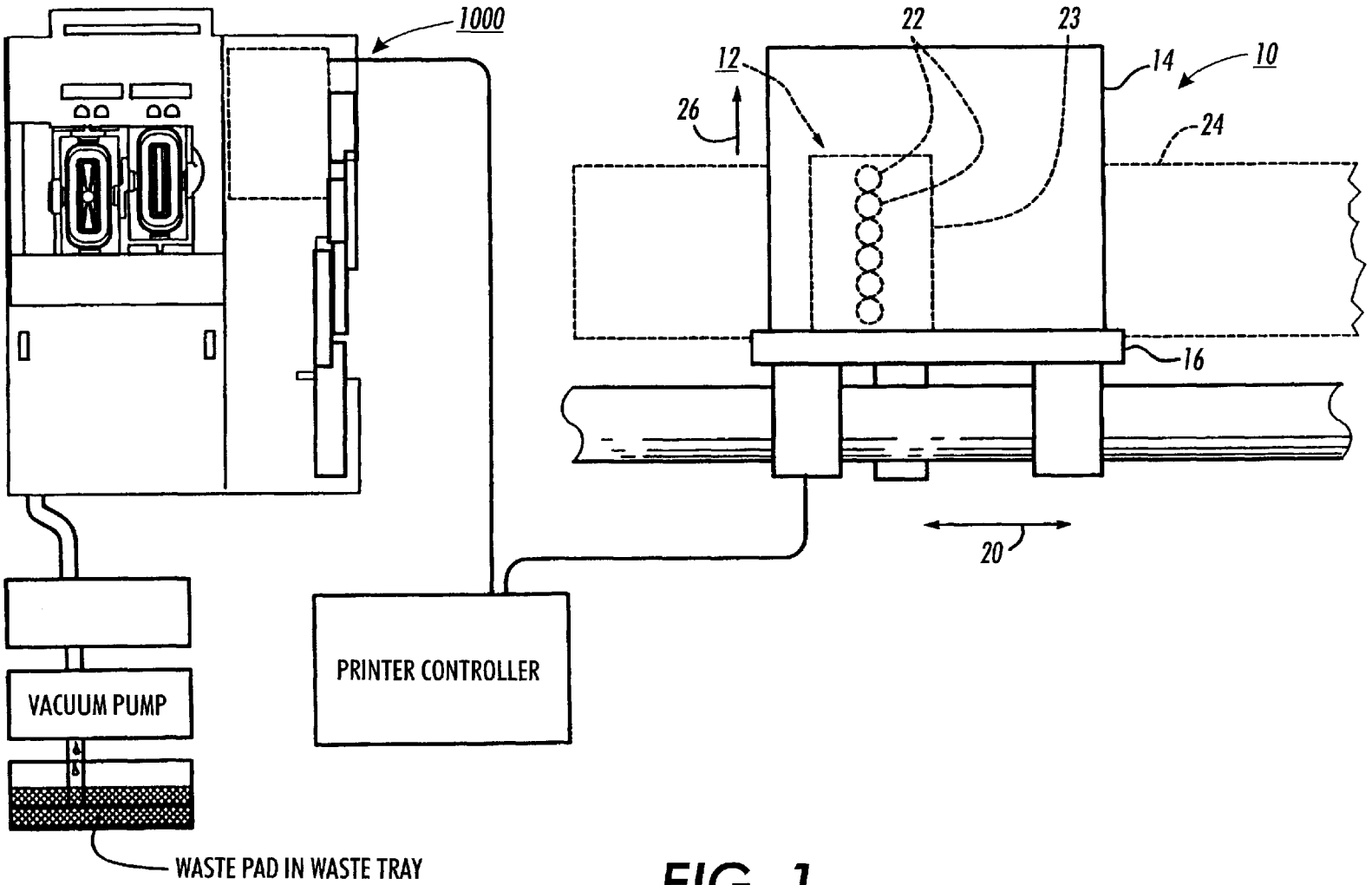
FIG. 1 is a schematic front elevation view of an ink jet printer and a maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by the arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of the arrow 26 for the distance or the height of one printed swath. U.S. Pat. No. 4,571,599 and Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

Figure 2:
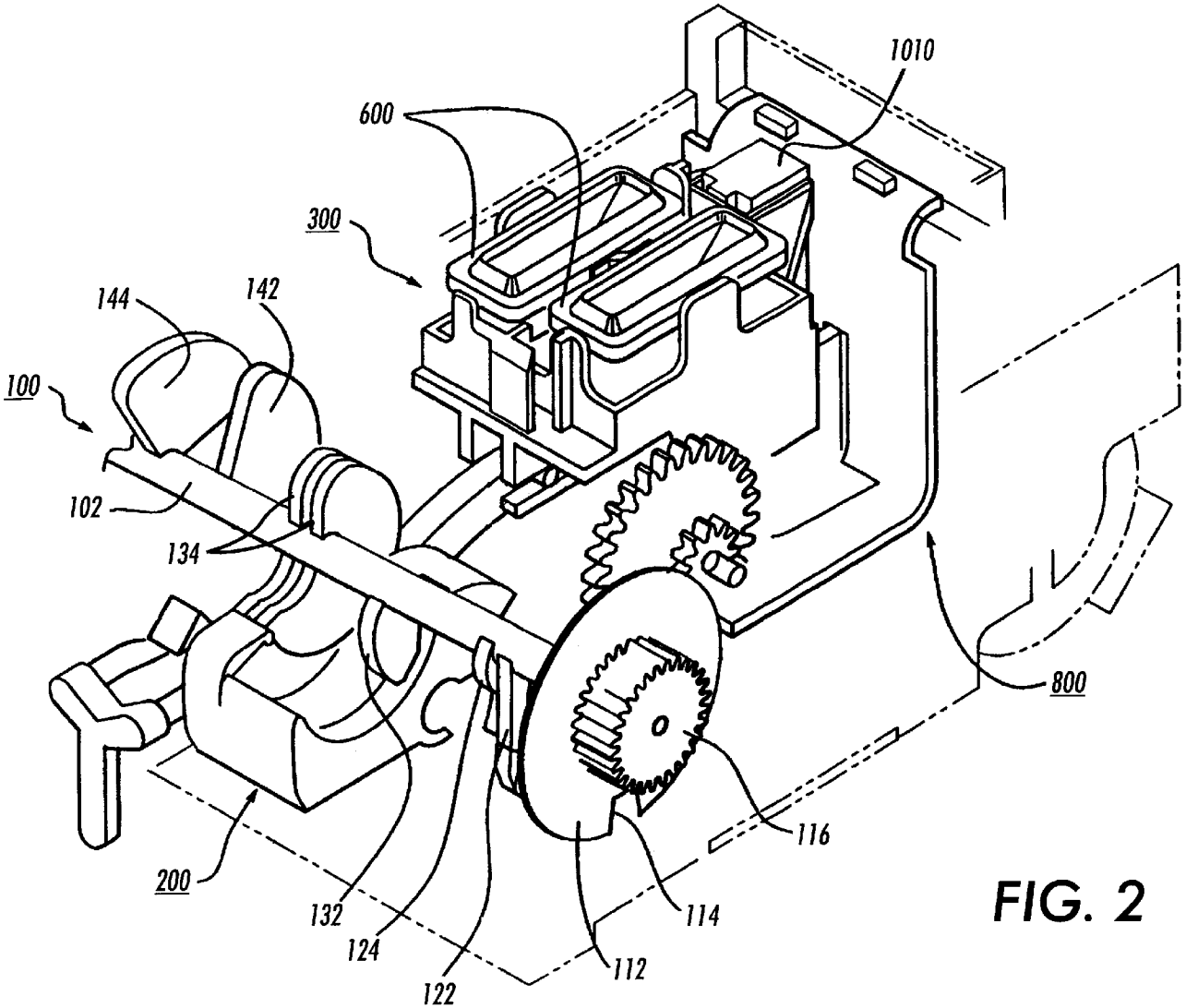
FIG. 2 is a top perspective view of the interior of the maintenance station of FIG. 1.

FIG. 2 is a top perspective view of the maintenance station 1000. As shown in FIG. 2, the maintenance station 1000 includes a cam shaft 100, a cam-actuated lever capping arm 200, and a cap carriage 300 mounted on a guide shaft 1010. In particular, as shown in FIG. 2, and more clearly seen in FIG. 3, the cam shaft 100 includes a driving and control portion 110, a wiper blade drive portion 120, a cam-actuated lever capping arm drive portion 130 and a pinch tube actuating portion 140.

Figure 3:
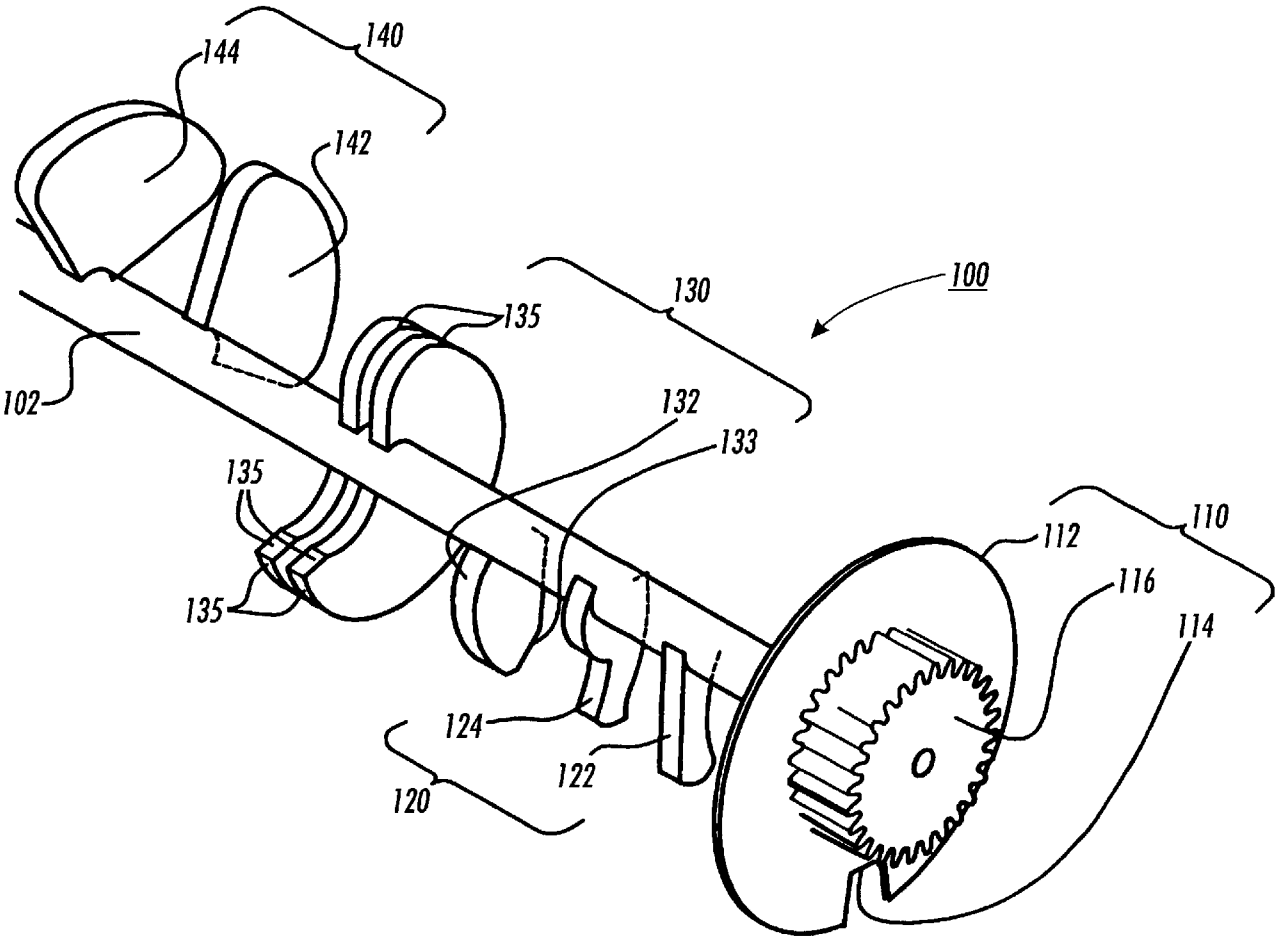
FIG. 3 is a partial perspective view of the cam shaft of FIG. 2.

In various exemplary embodiments, as shown in FIGS. 2 and 3, the driving and control portion 110 includes a sensor wheel 112, an optical window 114 formed in the sensor wheel 112, and a main drive gear 116. In operation, a drive gear train (see FIG. 14), comprising a drive motor connected to one or more drive gears, engages the main drive gear 116 to drive the cam shaft 100 in counterclockwise and then clockwise directions to actuate the various maintenance functions enabled by the maintenance station 1000.

In each of an extreme clockwise position of the cam shaft 100 and the extreme counterclockwise position of the cam shaft 100, the optical window 114 is aligned with an optical relay (not shown). Thus, after the drive gear train drives the main drive gear 116 to rotate the cam shaft 100 to the extreme clockwise or counterclockwise position, the optical window 114 formed in the sensor wheel 112 is aligned with the optical relay. In various exemplary embodiments, the optical relay includes a photo-emitter positioned on one side of the sensor wheel 112 and a photo-detector positioned on the other side of the sensor wheel 112. When the optical window 114 is not aligned with the optical relay, the optical relay is in an opened circuit condition.

At the start of a maintenance operation, the sensor wheel 112 is in the extreme clockwise position and the optical window 114 is aligned with the optical relay to close the circuit through the optical relay. As a result, when the one or more printheads 12 are aligned with the maintenance station 1000 and the main drive gear 116 is initially driven in the counterclockwise direction, the optical window 114 is no longer aligned with the optical relay and the optical relay is placed into an open circuit condition. Then, when the sensor wheel 112 reaches its extreme counterclockwise position, the window 114 is again aligned with the optical relay. As a result, the optical relay is placed in the closed circuit condition.

The open and closed circuit conditions of the optical relay are sensed by a controller (not shown). In response, the controller stops the gear train engaged with the main drive gear 116 from turning the cam shaft 100 for a predetermined time. In particular, this predetermined time depends on the priming mode currently selected for the maintenance station 1000.

Once the predetermined time has elapsed, the controller starts the gear train to drive the main drive gear 116, and thus the cam shaft 100, in the clockwise direction. The cam shaft 100 continues rotating in the clockwise direction until the optical window 114 in the sensor wheel 112 is again aligned with the optical relay to again put the optical relay in a closed circuit condition. When the controller again senses the closed circuit condition of the optical relay, the controller again stops the gear train from driving the main drive gear 116, and thus the cam shaft 100, in the clockwise direction.

In particular, in various exemplary embodiments, when the cam shaft 100 first begins rotating in the counterclockwise direction, the wiper blade portion 120 drives a wiper blade platform (not shown) from a first position to a second position. Then, when the cam shaft 100 is driven in the clockwise direction, the wiper blade drive portion 120 of the cam shaft 100 lastly drives the wiper blade platform from the second position back to the first position to wipe the nozzle face 23 of the one or more printheads 12 before the printhead 14 is moved from the maintenance station 1000 to the printing zone 24. However, it should be appreciated that in various other exemplary embodiments, the wiper blades 30 can be positioned so that the nozzle faces 23 are wiped when the wiper blade platform 1025 moves from the first position to the second position in addition to, or instead of, wiping when the wiper blade platform moves from the second position to the first position.

In various exemplary embodiments, after the wiper blade drive portion 120 moves the wiper blade platform from the first position to the second position, the cam shaft 100 rotates further in the counterclockwise direction. As a result, the cam-actuated lever capping arm drive portion 130 interacts with a cam-actuated lever arm 200 to move a cap carriage 300 from a disengaged position to an engaged position. In the engaged position, one or more printhead caps 600 carried by the cap carriage 300 engage the one or more printheads 12 as the cam shaft 100 continues to rotate in the counterclockwise direction. Similarly, when the cam shaft 100 is driven in the clockwise direction, the cam-actuated lever capping arm drive portion 130 interacts with the cam-actuated lever arm 200 to move the capping carriage 300 from the engaged position to the disengaged position, before the wiper blade drive portion 120 moves the wiper blade platform from the second position back to the first position. This is described in greater detail below. The structure and operation of the printhead caps 600 are described in greater detail in copending U.S. patent application Ser. Nos. 09/594,682 and 09/594,690, each filed herewith and incorporated herein by reference in their entirety.

Then, after the predetermined time has elapsed, the controller engages the drive motor of the drive gear train to rotate the cam shaft 100 in the clockwise direction. When the cam shaft 100 is rotated in the clockwise direction, the pinch tube actuation portion 140 again interacts with the one or more pinch tubes before the cap carriage 300 is moved from the engaged position to the disengaged position by the cam-actuated lever capping arm drive portion 130, which occurs before the wiper blade drive portion 120 moves the wiper blade platform from the second position to the first position.

Figure 14:
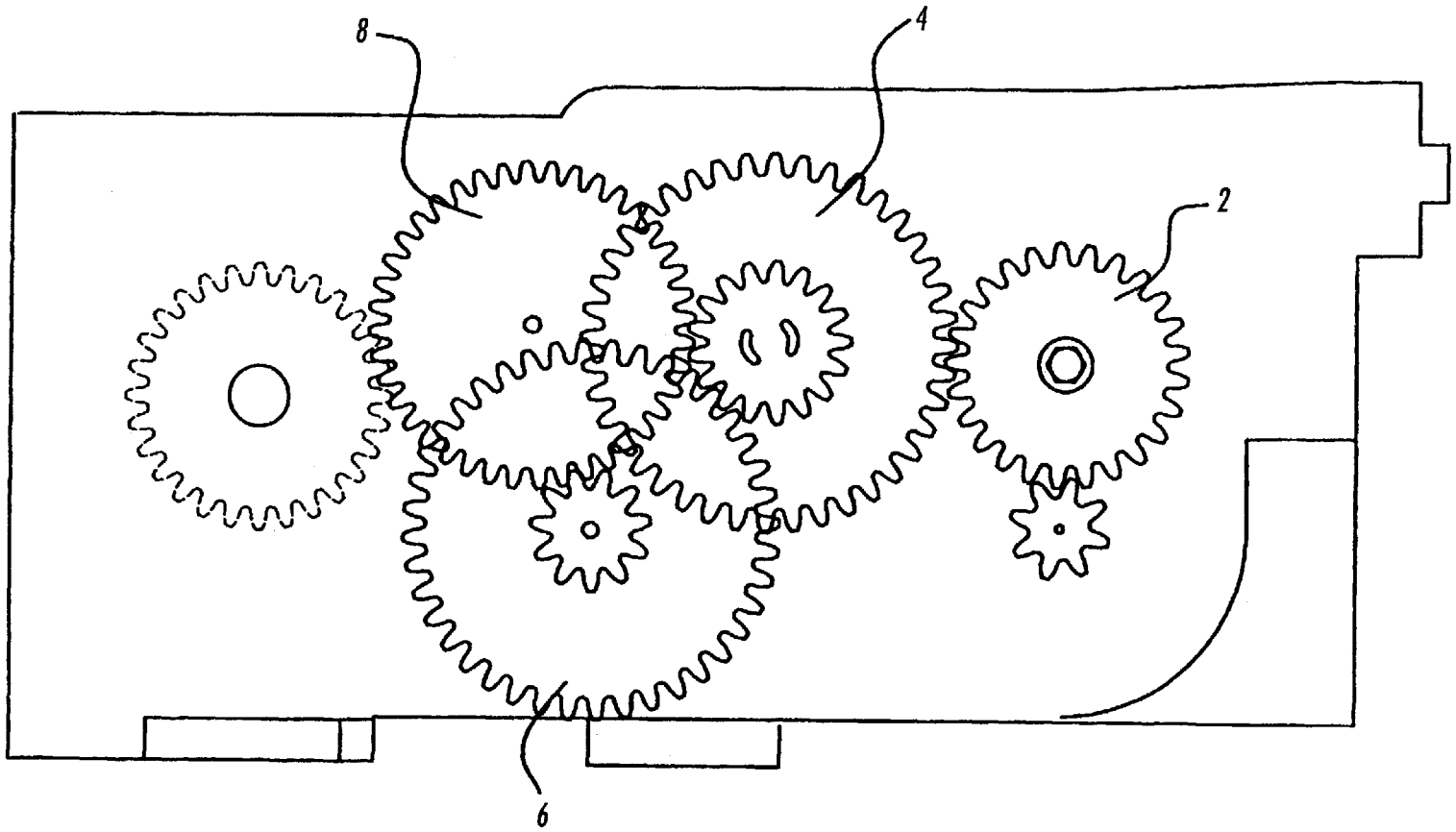
FIG. 14 is a perspective view of the maintenance station of FIG. 1 and gear train.
Figure 15:
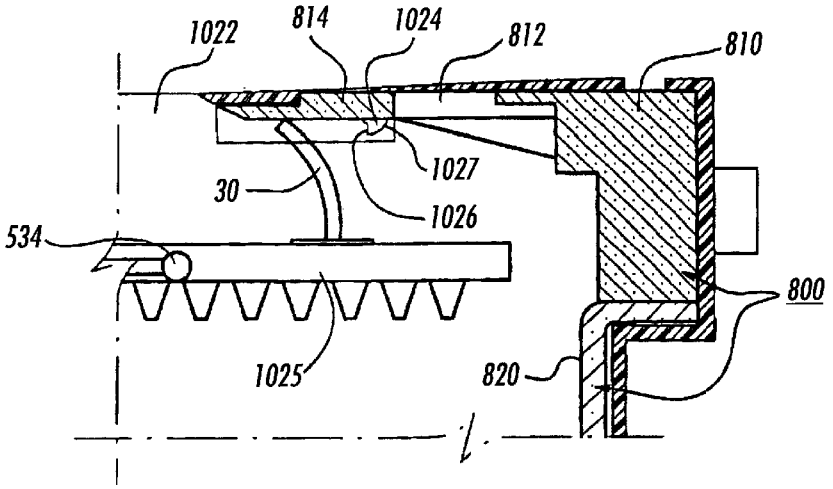
FIG. 15 is a plan perspective view of the cover for the maintenance station of FIG. 1, showing the wiper blade starting its return pass under the ink absorbing material.
Figure 16:
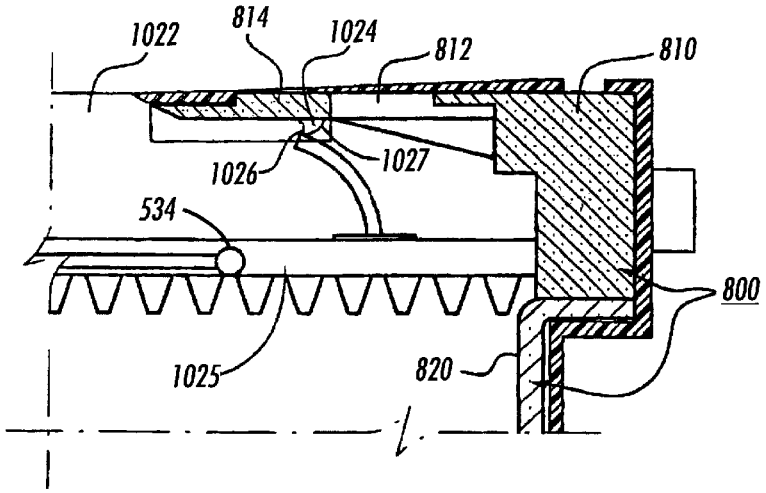
FIG. 16 is a plan perspective view of the cover or the maintenance station of FIG. 1, showing the wiper blade continuing its return pass under the ink absorbing material.
Figure 17:
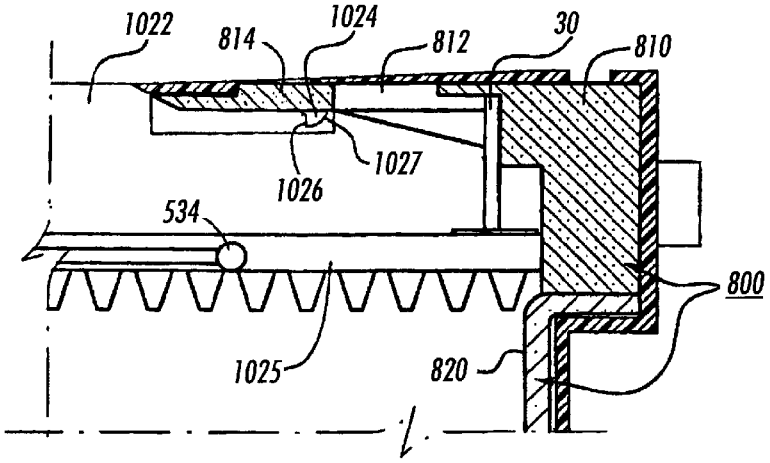
FIG. 17 is a plan perspective view of the cover for the maintenance station of FIG. 1, showing the wiper blade after completing its return pass under the ink absorbing material.

FIG. 14 shows a perspective view of the maintenance station gear train. The motor (not shown) activates a front gear 2, which in turn activates gear 4. The second gear 4 activates a third gear 6, which in turn activates a fourth gear 8. The fourth gear 8 activates the drive gear 116. The ratio between the various gears in the gear train can be selected to provide any desired conversion factor between the torque and the rotational velocity provided by the drive motor and the desired rotational velocity and torque used with the cam shaft.

As shown in FIGS. 2 and 3, the various elements of the cam shaft drive portion 110, the wiper blade drive portion 120, the cam-actuated lever capping arm drive portion 130 and the pinch tube actuation portion 140 are mounted on a shaft 102 of the cam shaft 100. As shown in FIGS. 2 and 3, in various exemplary embodiments, the wiper blade drive portion 120 includes a forward wiper driving cam 122 that is used to drive the wiper blade platform from the first position to the second position, and a reverse wiper blade driving cam 124 that is used to drive the wiper blade platform from the second position back to the first position. Each cam 122 and 124 has a cam profile manufactured to optimize the pressure angle created by the cam with respect to the angular rotation of the cam shaft 100. Additionally, each cam 122 and 124 has been manufactured with multiple points of contact that in turn actuate or provide a hard stop to act against their respective followers 524 and 526 (described in greater detail below).

In the exemplary embodiments shown in FIGS. 2–10, the cam-actuated lever capping arm drive portion 130 includes a hold-down cam 132 and one or more capping cams 134. In particular, in the exemplary embodiments shown in FIGS. 2–10, the one or more capping cams 134 are provided as a dual capping cam. This dual capping cam allows the force or load between the capping cams 134 and the cam-actuated lever capping arm 200 to be distributed between the two capping cams 134 to reduce wear between the capping cams 134 and the cam-actuated lever capping arm 200. In various exemplary embodiments of the cam-actuated lever capping arm drive portion 130, the hold-down cam 132 has an outer surface 133 that engages the cam-actuated lever capping arm 200. Similarly, each of the one or more capping cams 134 has a curved surface 135 that also engages the cam-actuated lever capping arm 200.

In the exemplary embodiments shown in FIGS. 2 and 3, the cap carriage 300 carries two printhead caps 600, each having a separate pinch tube. Accordingly, the pinch tube actuation portion 140 includes a first pinch tube actuating cam 142 and a second pinch tube actuation cam 144. The first pinch tube actuating cam 142 actuates a first pinch mechanism to pinch a first tube connected to the first one of the two printhead caps 600. Similarly, the second pinch tube actuating cam 144 actuates a second pinch mechanism to pinch a second tube connected to the second one of the two printhead caps 600.

Figure 4:
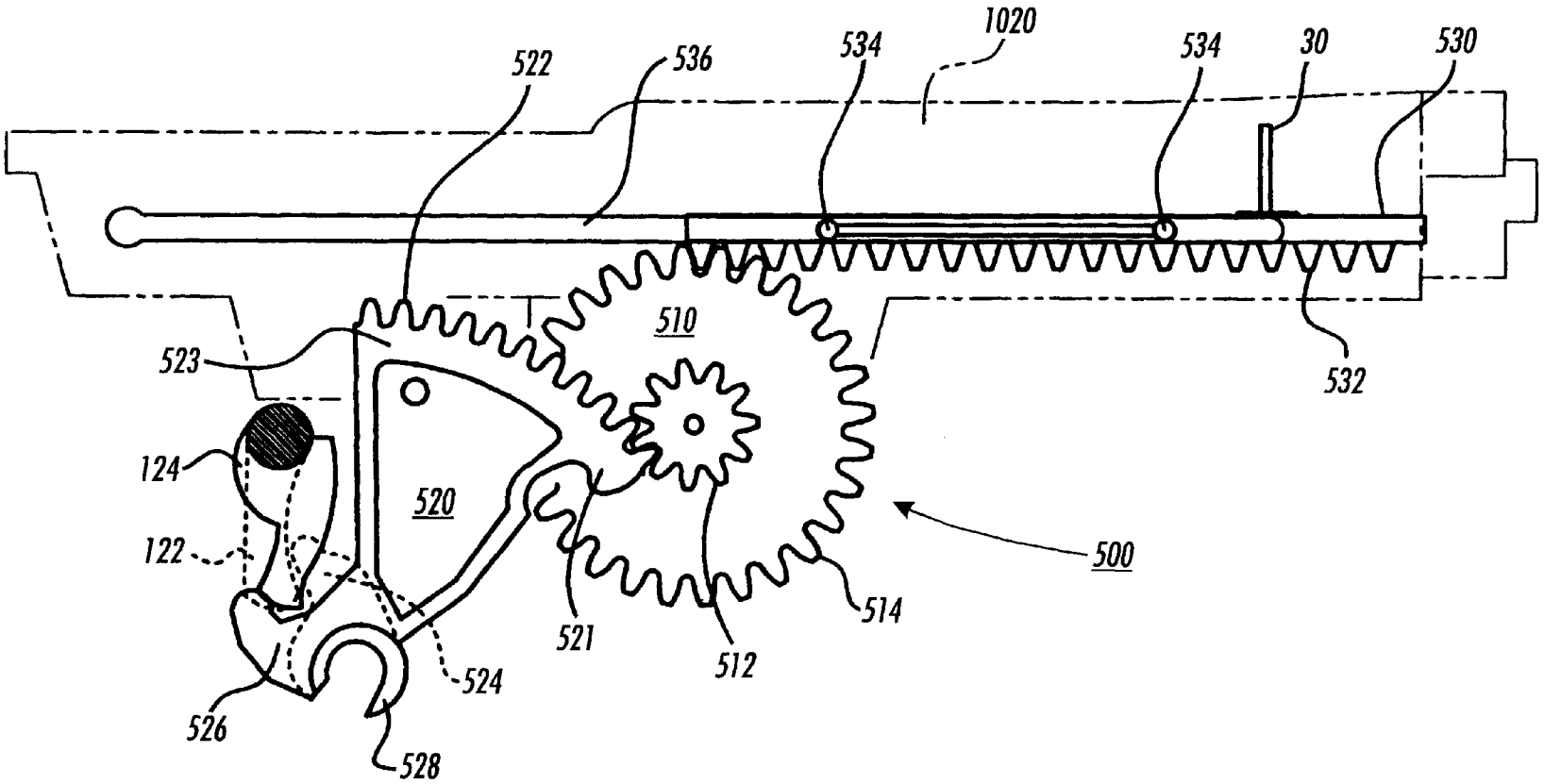
FIG. 4 is a plan view of the wiper blade platform and the wiper blade drive mechanism, when the wiper blade platform is in a first position.
Figure 5:
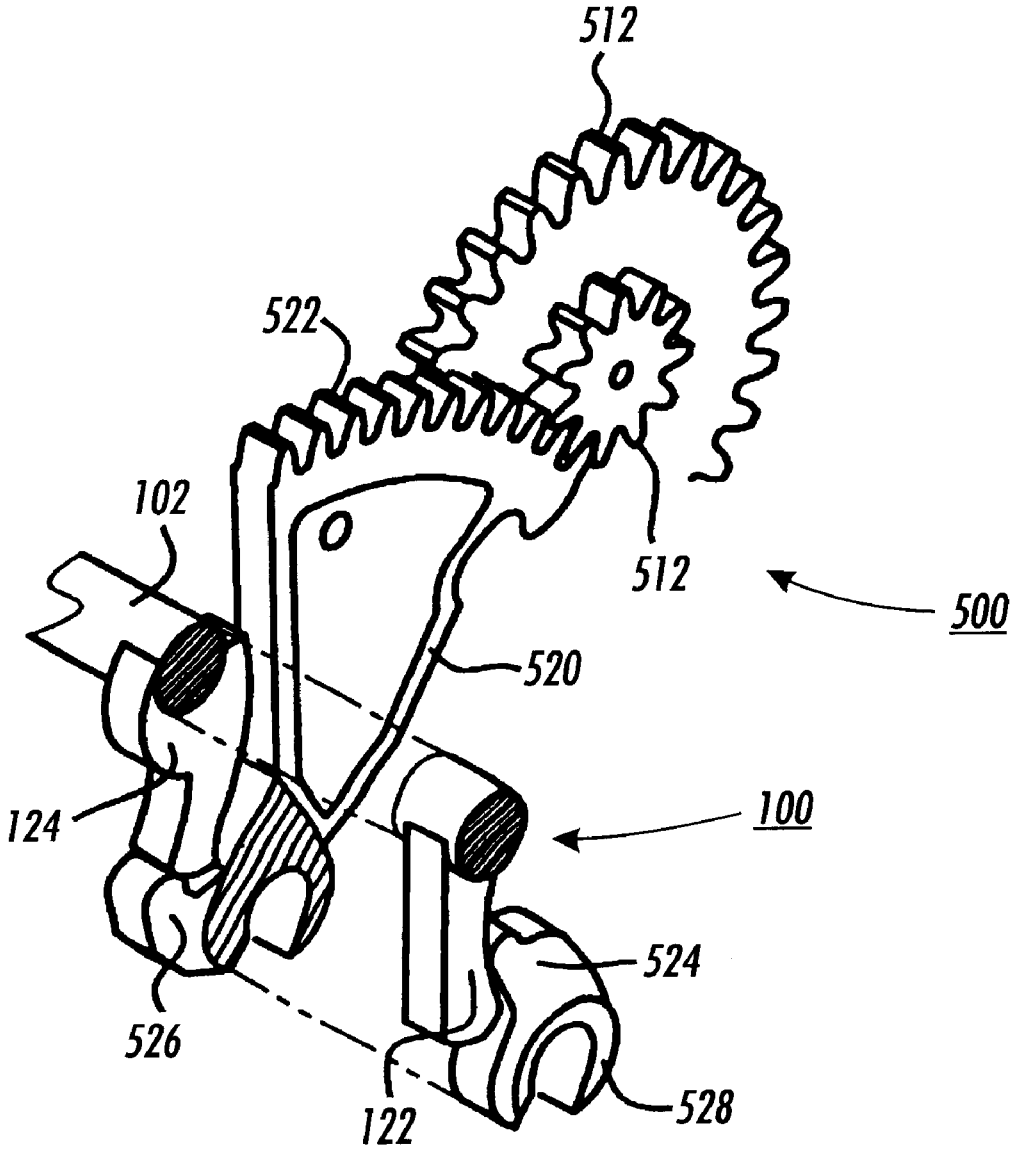
FIG. 5 is a perspective view of the wiper blade drive mechanism in the first position.

FIGS. 4 and 5 show side plan and perspective views of the wiper blade drive portion 120 of the cam shaft 100, the wiper blade drive mechanism 500 and the wiper blade platform 530. As shown in FIGS. 4 and 5, the wiper blade drive mechanism 500 includes a sector gear 520 and a pinion gear 510. In particular, the sector gear 520 includes a gear portion 522, a cam stop 524, a cam follower 526 and a mounting portion 528. In various exemplary embodiments, the mounting portion 528 rotatably mounts the sector gear 520 on a fixed shaft of the maintenance station 1000. The pinion gear 510 includes a first gear portion 512 and a drive gear portion 514. The wiper blade platform 530 includes a rack gear 532 mounted on a surface of the wiper blade platform 530 that faces the pinion gear 510.

On the opposite surface of the wiper blade platform 530, one or more wiper blades 30 are mounted to extend towards the one or more printheads 12 when the one or more printheads 12 are positioned adjacent to the maintenance station 1000. The wiper blade platform 530 also includes a number of laterally extending pins 534 that extend through a wiper blade slot 536 formed in a side wall 1020 of the maintenance station 1000. The laterally extending pins 534 extend through the slot 536 and slidably retain the wiper blade platform in the slot 536.

Figure 6:
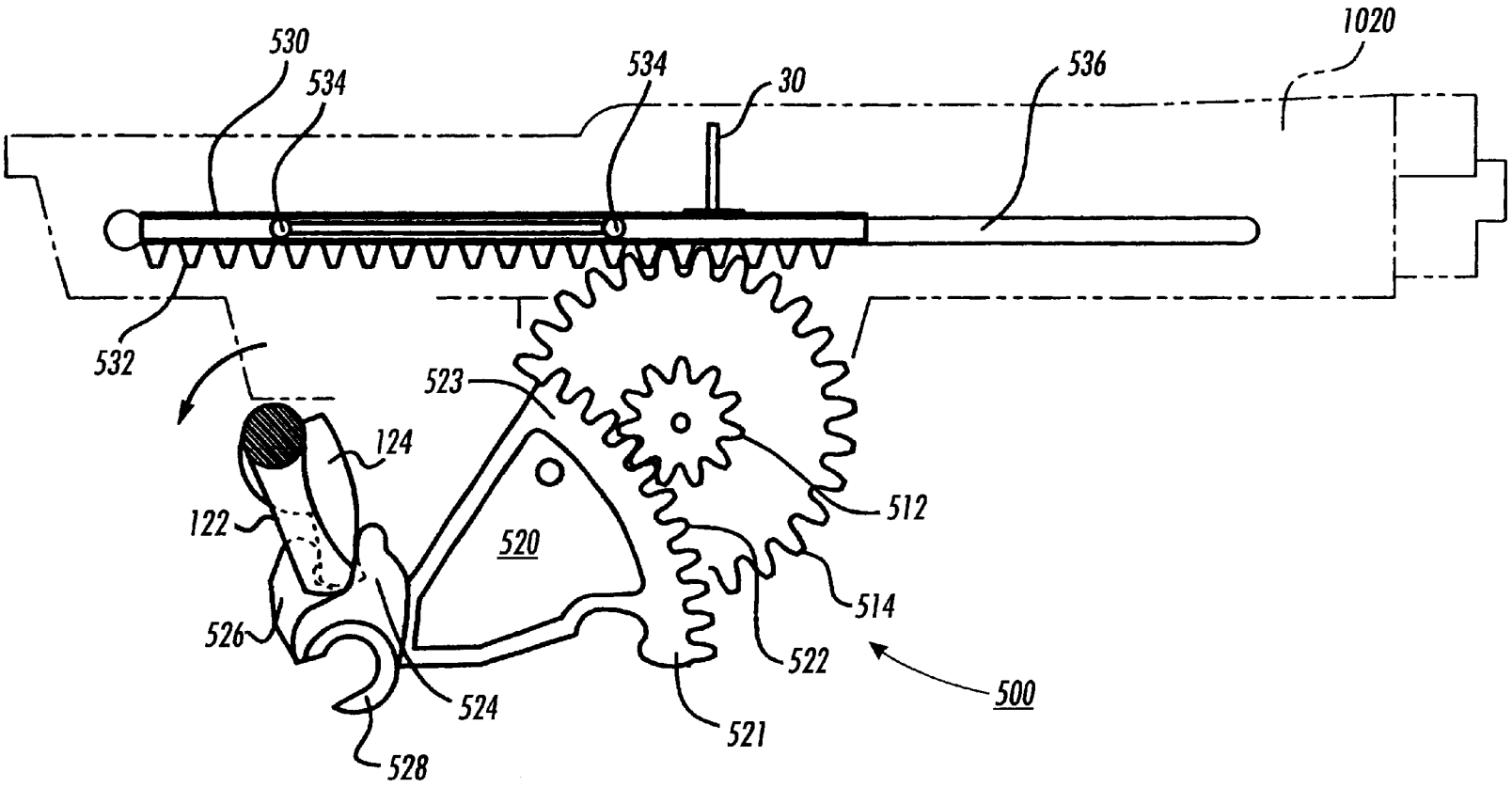
FIG. 6 is a plan view of the wiper blade platform and the wiper blade drive mechanism as the cam shaft turns counterclockwise to move the wiper blade platform from the first position to a second position.

In various exemplary embodiments, the pinion gear portion 512 of the pinion gear 510 is engaged with the gear portion 522 of the sector gear 520. At the same time, the drive gear portion 514 of the pinion gear 510 is engaged with the rack gear portion 532 of the wiper blade platform 530. As a result, when the pinion gear 510 rotates counterclockwise, the drive gear portion 514 meshes with the rack gear portion 532 to move the wiper blade platform 530 from the first position, shown in FIG. 4 to the second position as shown in FIG. 6. In contrast, when the pinion gear 510 rotates in the clockwise direction, the drive gear portion 514 of the pinion gear 510 meshes with the rack gear portion 532 of the wiper platform 530 to move the wiper blade platform 530 from the second position, shown in FIG. 6 to the first position, as shown in FIG. 4.

In various exemplary embodiments, the gear portion 522 of the sector gear 520 meshes with the pinion gear portion 512 of the pinion gear 510, such that, when the wiper blade platform 530 is in the first position, a first end 521 of the gear portion 522 meshes with the pinion gear portion 512, as shown in FIG. 4. In contrast, as shown in FIG. 6, when the wiper blade platform 530 is in the second position, a second end 523 of the gear portion 522 of the sector gear 520 meshes with the pinion gear portion 512 of the pinion gear 510.

Figure 7:
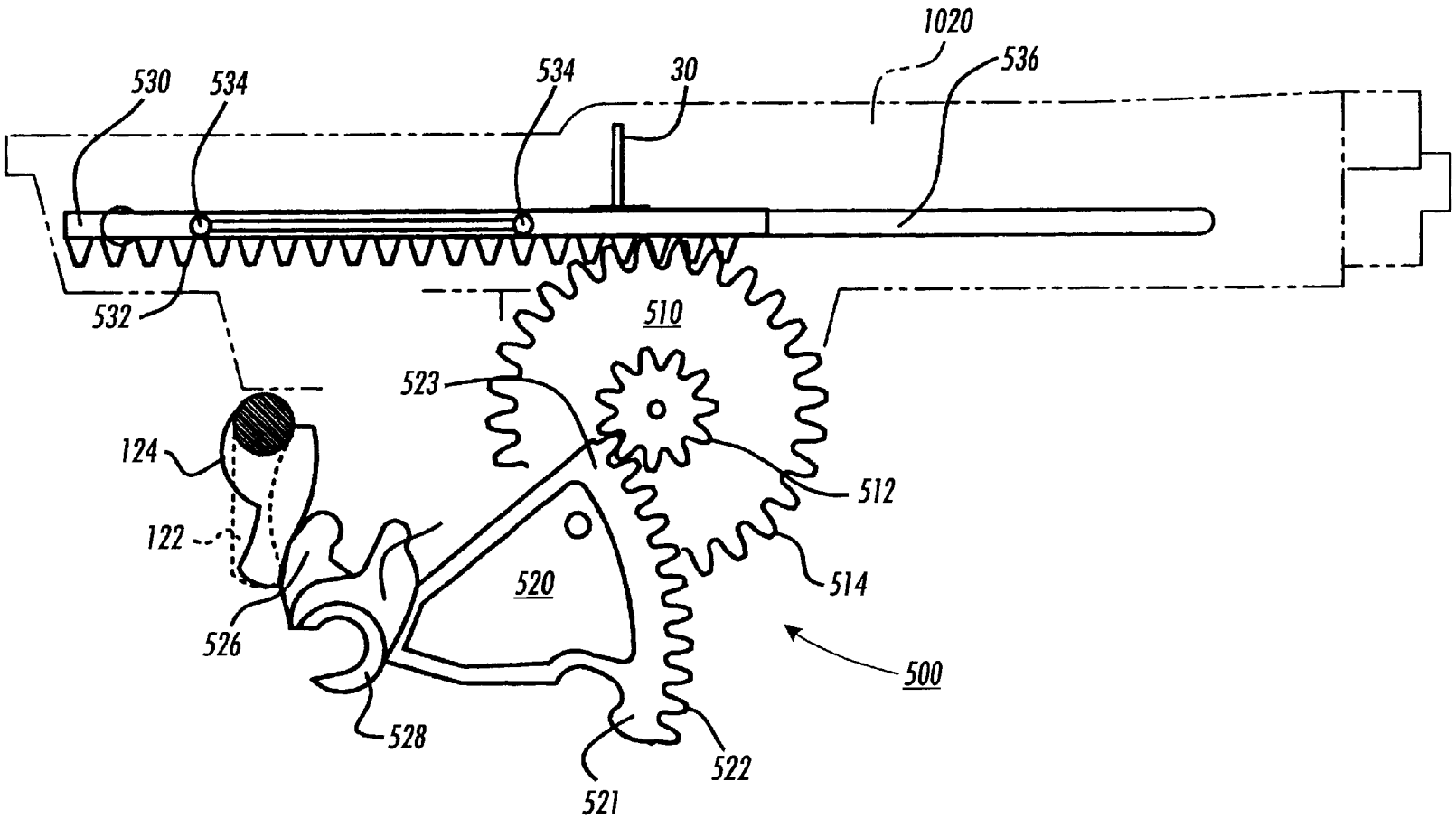
FIG. 7 is a plan view of the wiper blade platform and the wiper blade drive mechanism in the second position, with the cam shaft in an extreme counterclockwise position.

In operation, when the cam shaft 100 is in the extreme clockwise position, the reverse wiper cam 124 of the wiper blade drive portion 120 locks against the cam follower 526 of the sector gear 520. Then, as shown in FIGS. 6 and 7, when the cam shaft 100 is rotated in the counterclockwise direction, the wiper cam 122 pushes against the cam stop 524. This causes the sector gear 520 to rotate about the fixed shaft on which the mounting portion 528 is mounted in the clockwise direction. This clockwise rotation of the sector gear 520 causes the pinion gear 510 to rotate clockwise to drive the wiper blade platform 530 from the first position as shown in FIGS. 4 and 5 toward the second position, shown in FIG. 6.

Eventually, further counterclockwise rotation of the cam shaft 100 causes the wiper cam 122 to disengage from the cam stop 524 just as the second end 523 of the gear portion 520 of the sector gear 520 meshes with the pinion gear portion 512 of the pinion gear 510 and as the wiper blade platform 530 reaches the second position, shown in FIG. 7. Thus, any further rotation of the cam shaft 100 causes no further rotation of the sector gear 520. As the cam shaft 100 continues to rotate in the counterclockwise direction to the extreme counterclockwise position, the reverse cam wiper 422 contacts the cam follower 526. In particular, the reverse wiper cam 124 contacts the cam follower 526 in such a way that the further rotation of the cam shaft 100 in the counterclockwise direction is effectively prevented.

Figure 8:
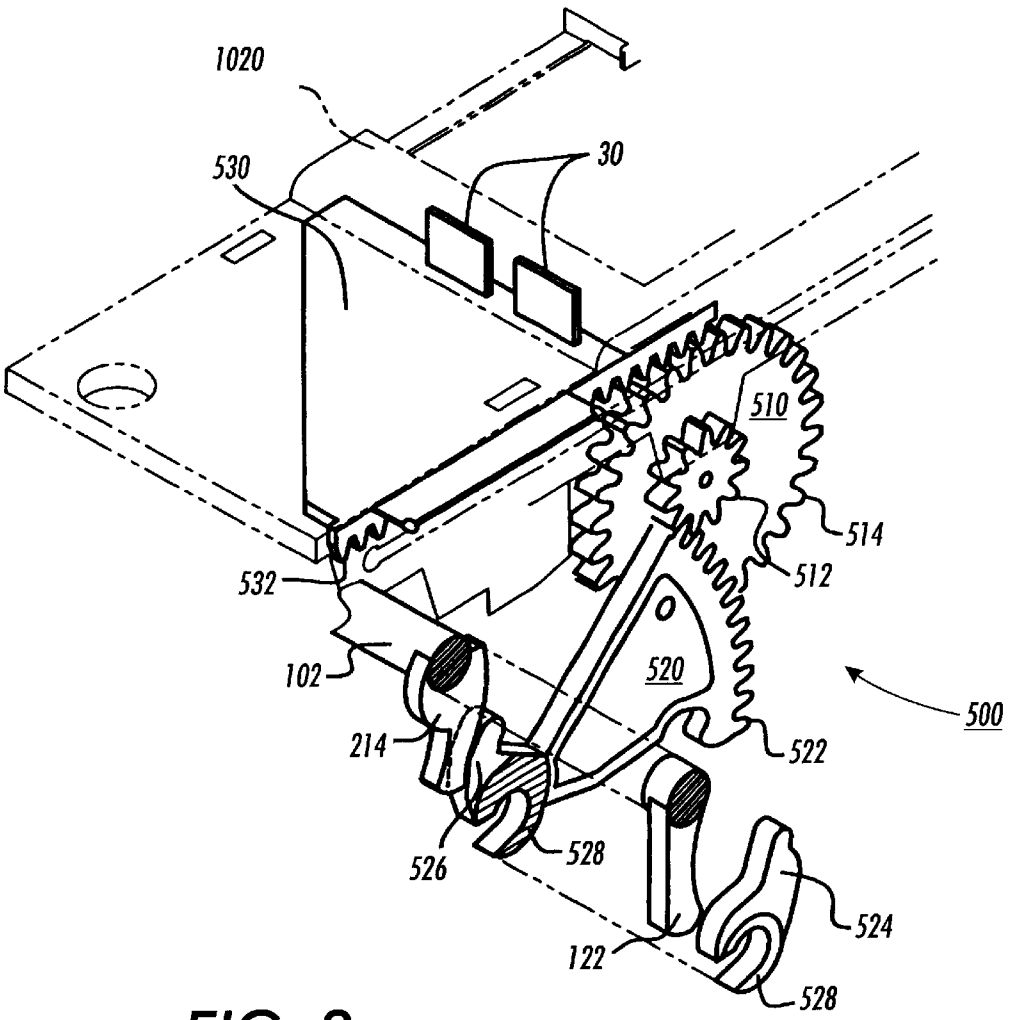
FIG. 8 is a perspective view of the wiper blade platform and the wiper blade drive mechanism in the second position, with the cam shaft in the extreme counterclockwise position.

When the cam shaft is subsequently rotated in the clockwise direction from the extreme counterclockwise position shown in FIGS. 7 and 8, the reverse cam wiper 124 disengages from the cam follower 526 and begins rotating toward the opposite surface of the cam follower 526. Eventually, after the cam shaft 100 has rotated from the extreme counterclockwise position significantly towards the extreme clockwise position, the wiper cam 122 moves back passed the cam stop 524, but does not engage the cam stop 524. Further rotation of the cam shaft 100 in the clockwise direction causes the reverse wiper cam 124 to engage the follower surface of the cam follower 526 of the sector gear 520.

Figure 9:
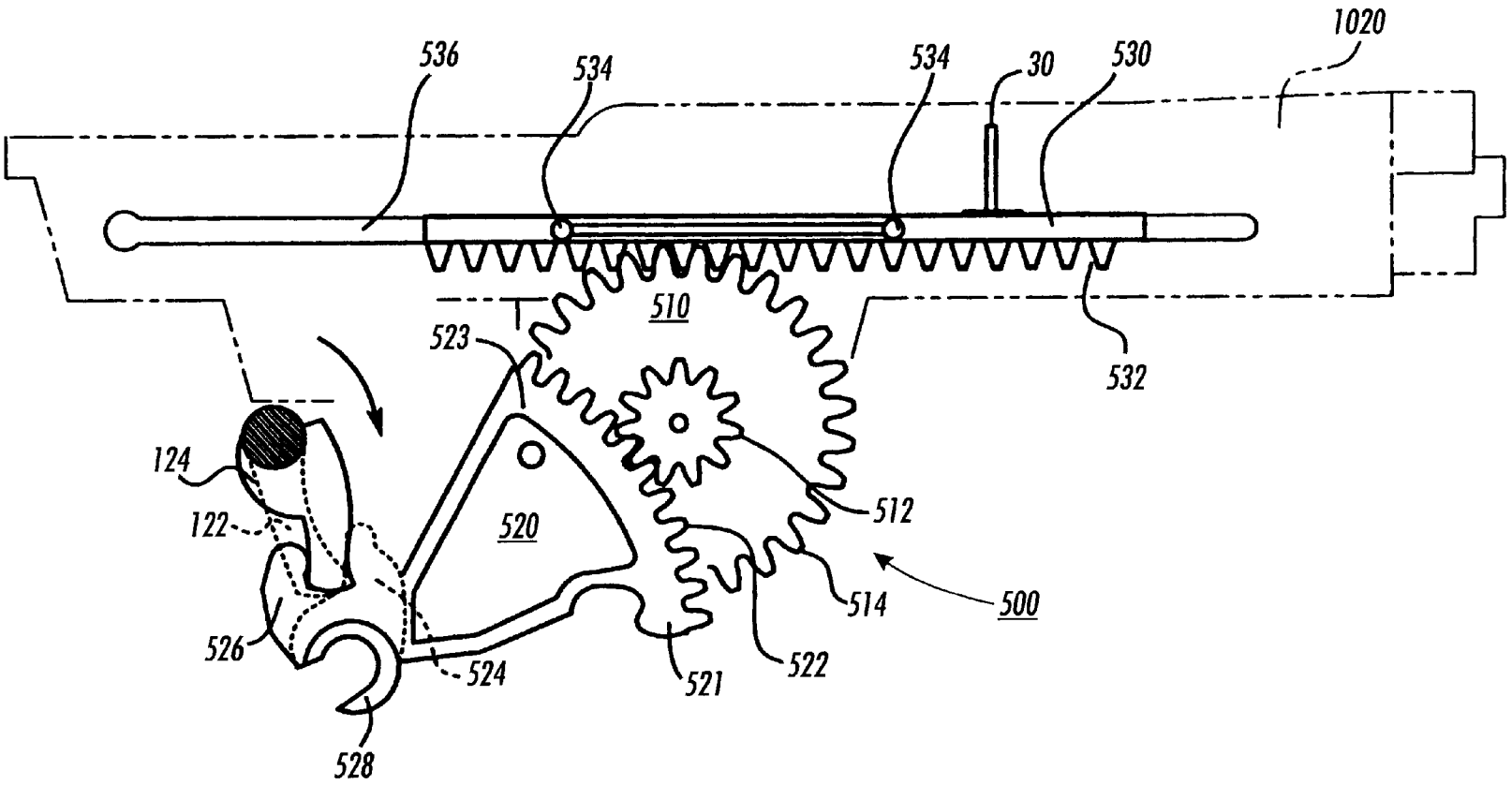
FIG. 9 is a plan view of the wiper blade platform and as the cam shaft turns clockwise to move the wiper blade platform from the second position to the first position.

As shown in FIG. 9, further clockwise rotation of the cam shaft 100 causes the reverse wiper cam 124 to bear against the cam follower 526, which causes the sector gear 520 to rotate counterclockwise about the fixed shaft on which the mounting portion 528 is mounted. As a result, the portion of the gear portion 522 of the sector 520 that meshes with the pinion gear portion 512 of the pinion gear 510 moves from the second end 523 towards the first end 521. As a result, the pinion gear 510 rotates in the clockwise direction. This clockwise rotation of the sector gear 510 and thus the drive gear portion 514 drives the wiper blade platform from the second position, as shown in FIGS. 7 and 8, towards the first position, as shown in FIGS. 4 and 5. As the first end 521 of the gear portion 522 of the sector gear 520 meshes with the pinion gear portion 512 of the pinion gear 510, the cam shaft 100 reaches its extreme clockwise position and the wiper blade platform is returned to the first position as shown in FIGS. 4 and 5.

Figure 10:
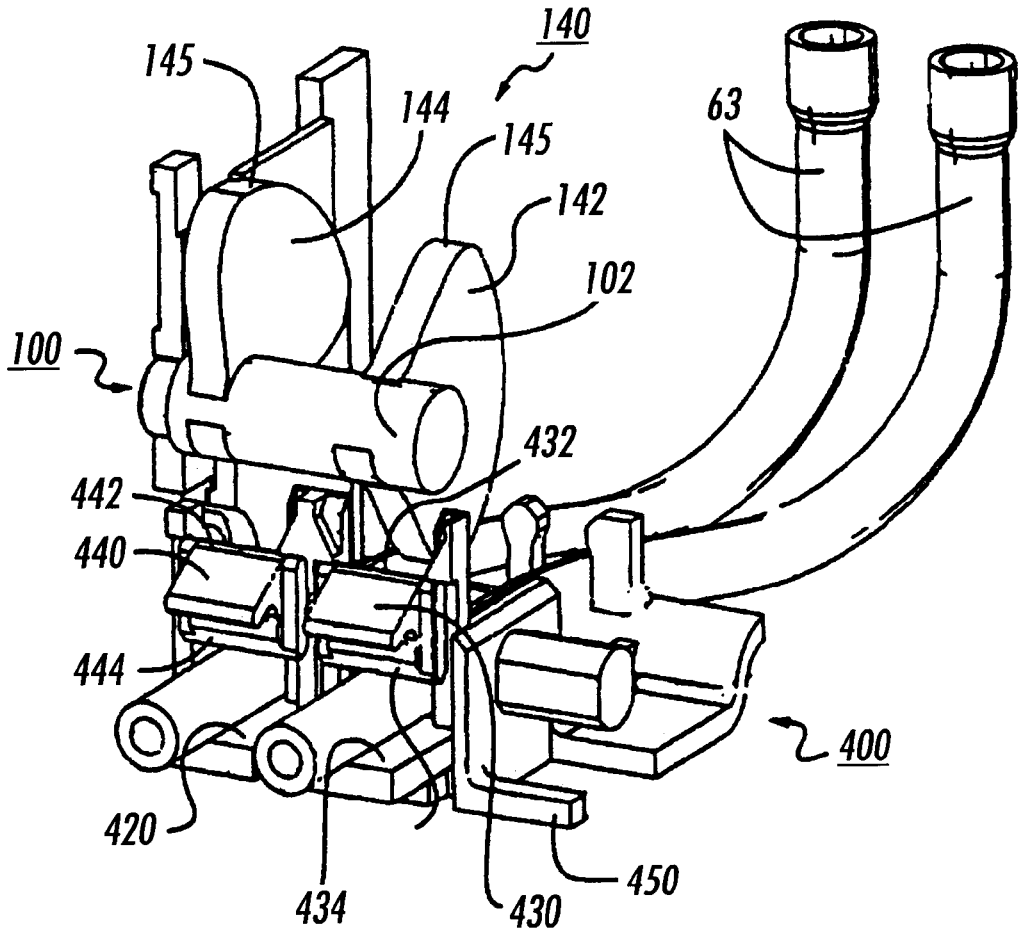
FIG. 10 is a perspective view of the pinch tube mechanism and the cam shaft, showing the pinch tube mechanism with the pinch tubes in an inactive, open positions.

As shown in FIG. 10, each of the first and second pinch cams 142 and 144 has a arcuate bearing surface 145 that is engagable with a bearing surface 432 and 442 of the pinch valves 430 and 440, respectively. When the bearing surface 145 on the first and second pinch cams 142 and 144 bears against the corresponding bearing surface 432 and 442 of the corresponding pinch valves 430 and 440, respectively, a pinch portion 434 and 444, respectively, of the pinch valves 430 and 440 presses against the corresponding one of the pinch tubes 63. This is shown in greater detail in FIG. 10. In particular, the pinch tubes 63 are compressed between the pinching portions 434 and 444 of the pinch valves 430 and 440, respectively, and the corresponding compressible pads 410 and 420 to substantially, if not completely, block or close the pinch tubes 63 against a pressure applied to the pinch tube 63 and/or against the flow of ink through the pinch tube 63 from the printed caps 600.

In various exemplary embodiments, the pinch valves 430 and 440 and a frame 450 of the pinch tube mechanism 400 are formed from a rigid plastic material. The pinch valves 430 and 440 are slidably inserted into grooves formed in the frame 450 to securely position the pinch valves 430 and 440 over the pinch tubes 63 and in a proper relative position with respect to the compressible pads 410 and 420. In various exemplary embodiments, the pinch valves 430 and 440 are snap-inserted into the parallel grooves formed in the frame 450. In various exemplary embodiments, the pinch valves 430 and 440 move linearly in the grooves formed in the frame 450 to compress the pinch tubes 63 passing under the pinch valves 430 and 440 and over the compressible pads 410 and 420 respectively.

The compressible pads 410 and 420 provide a compliance when the pinch valves 430 and 440 are crushed against the pinch tubes 63 to compress the pinch tubes 63. The compliance provided by the compressible pads 410 and 420 tend to reduce the amount of energy necessary to be applied to the pinch tubes 63 by the pinch valves 430 and 440 necessary to substantially or completely close the pinch tube 63. The compliance provided by the compressible pads 410 and 420 also permits a wide variation in the outer diameter of the pinch tubes 63 that can be used with the pinch tube mechanism 400, as well as allowing significant tolerances in part dimensions without the operation of the pinch tube mechanism 400 being negatively affected, especially when the part tolerances stack up. As described above, the pinch valves 430 and 440 are pressed against the pinch tubes 63 by the bearing services 140 of the pinch cams 142 and 144, respectively. As the cam shaft 100 rotates both clockwise and counterclockwise.

Figure 11:
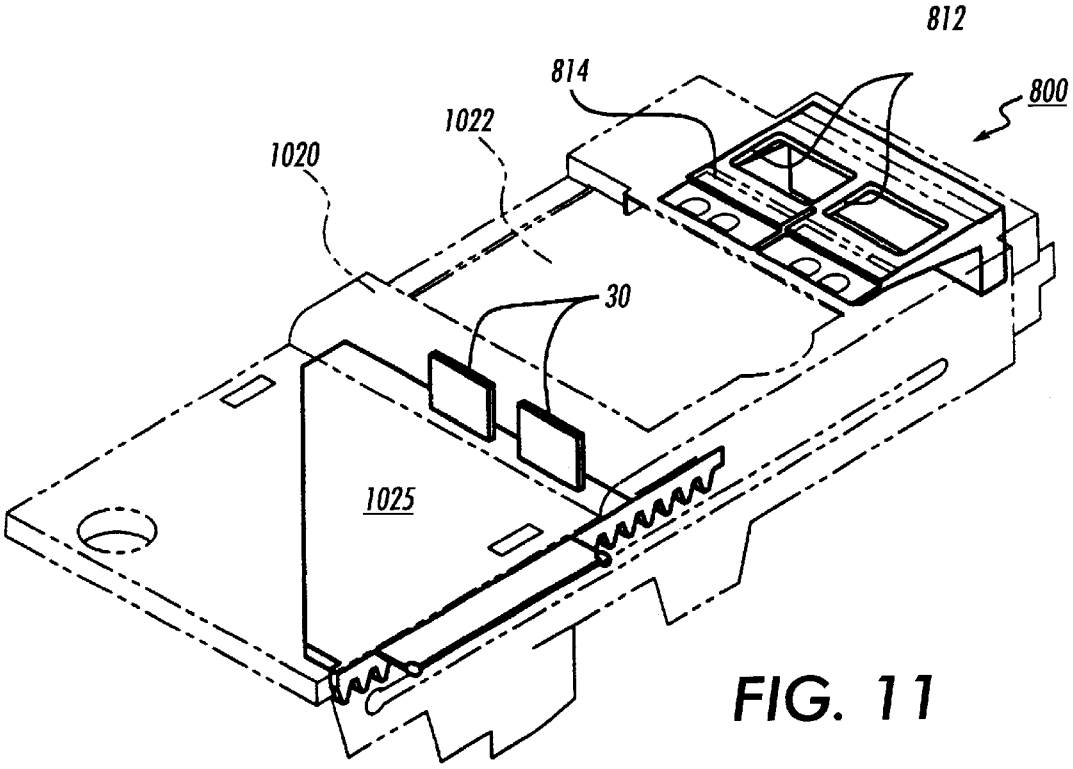
FIG. 11 is cut-away and exploded perspective view of the wiper blade platform and a first portion of the ink blotter within the maintenance station of FIG. 1.
Figure 12:
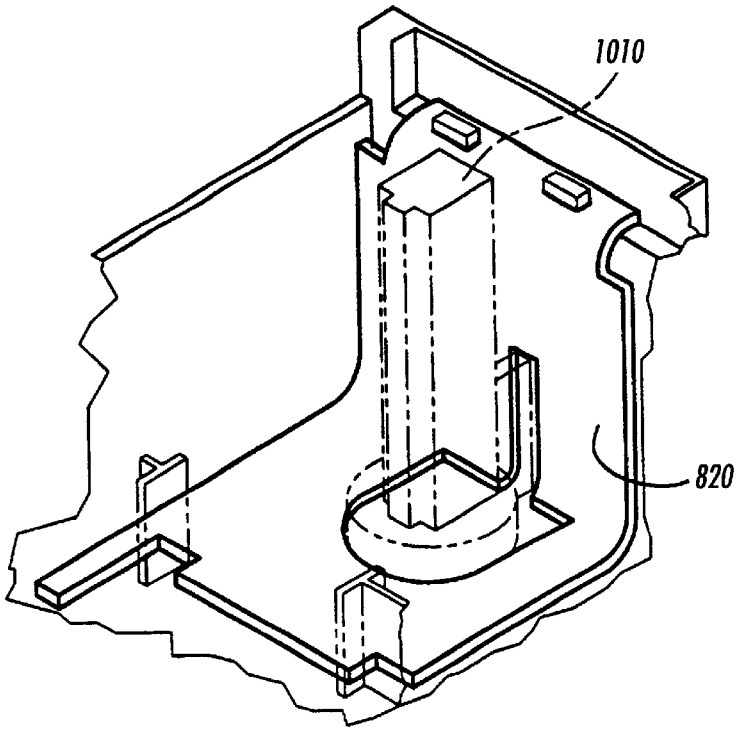
FIG. 12 is a perspective view of a second portion of the ink blotter within the maintenance station of FIG. 1.
Figure 13:
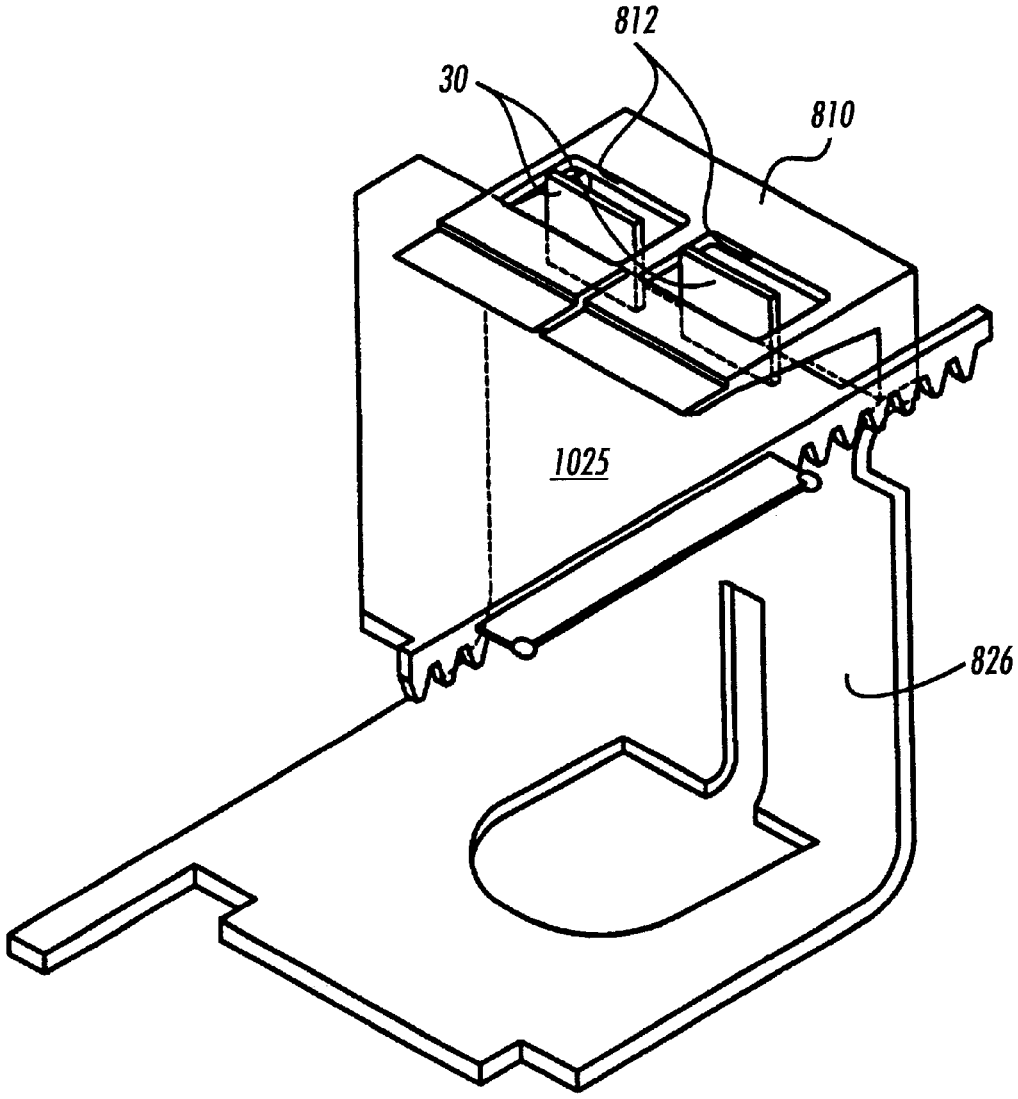
FIG. 13 is a perspective view of the wiper blades platform and first and second portions of the ink blotter when the wiper blade platform is in the first position.

FIGS. 11–13 and 15–17 show one exemplary embodiment of the improved capacity ink blotter 800 of the maintenance station 1000 and the wiper blade platform 1025 and the wiper blade mechanism according to this invention. In particular, FIG. 11 shows a first portion 810 of the improved capacity ink blotter 800, while FIG. 12 shows a second portion 820 of the high capacity ink blotter 800 and FIG. 13 shows both of the first and second portions 810 and 820 of the high capacity ink blotter 800. Each of FIGS. 11–13 and 15–17 also show the wiper blades 30.

In various exemplary embodiments, as shown in FIG. 11, the first portion 810 of the high capacity ink blotter 800 is positioned in a cover portion 1020 of the ink station 1000. FIG. 11 also shows an opening 1022 provided in the cover portion 1020 of the ink station 1000 and the wiper blade platform 1025 in the second position such that the wiper blade platform 1025 does not extend into the opening 1022. When the wiper blade platform 1025 moves from the second position shown in FIG. 11, to the first position, the wiper blades 30 engage the first portion 810 of the high capacity ink blotter 800.

In particular, when the wiper blade platform 1025 moves from the second position to the first position the wiper blades 30 contact a leading portion 814 of the first portion 810. The leading portion 814 absorbs any liquid ink on the wiper blades 30 and fractionally dislodges any non-liquid ink and/or debris or other contamination from the wiper blades 30. In various exemplary embodiments, as the wiper blade platform 1025 moves from the second position towards the first position, the wiper blades 30 contact a scraper bar 1024. The edge of wiper blades 30 momentarily catches in a notch 1026 of the scraper bar 1024.

As the wiper platform 1025 continues towards the first position, the wiper blades 30 snap out of the notch 1026 and flick waste ink and debris onto a side wall portion 1034 of a bottom portion 1030 of the maintenance station 1000 of the ink station 1000. This waste ink and debris travels down the wall portion 1034 and collects on a spittoon portion 822 of the second portion 820 of the high capacity ink blotter 800. Once deposited on the spittoon, this waste ink and/or debris is absorbed into and gradually spreads out in all directions within the second portion 820 of the high capacity ink blotter 800. The additional surface area provided by the second portion of the high capacity ink blotter 800 increases the ability of the waste ink collected at the spittoon 822 to evaporate.

As the wiper blade platform 1025 reaches the first position, the wiper blades 30 detach from the leading portion 814 and extend through a pair of holes 812 formed in the first portion 810 of the high capacity ink blotter 800. This removes any bending forces from the wiper blades 30 and ensures the wiper blades 30 do not become bent or otherwise distorted due to contact with the first portion 810 of the high capacity ink blotter 800.

In a like manner, when the wiper blades platform 1025 moves from the first position towards the second position, the opposite surfaces of the wiper blades 30 now contact the leading portion 810 as the wiper blades 30 move from the openings 812 toward the opening 1022. As the wiper blade platform 1025 moves from first position towards the second position, the wiper blades 30 again contact the scraper bar 1024. The edge of wiper blades 30 easily pass over a sloped side 1027 of the scraper bar 1024. The sloped side 1027 requires less force to drive the wiper blades 30 up and beyond the scraper bar 1024 as the wiper blades 30 move from the first position to the second position. This creates less stress on the drive motor of the drive gear train and reduces wear on the wiper blade 30. As a result, any liquid ink on these surfaces of the wiper blades 30 is absorbed by the leading portion 814, which also fractionally dislodges any dried ink, debris or other contamination from this surface of the wiper blades 30.

As the wiper blades 30 wipe ink, debris and other contamination from the nozzle surfaces 23 of the printheads 12, and deposit the removed ink, debris and other contamination on the leading portion 814 of the first portion 810 of the ink blotter 800, the first portion 810 eventually becomes more or less saturated with liquid ink. To improve the capacity of the ink blotter 800, and to absorb liquid ink from the first portion 810, the significantly larger second portion 820 securely contacts the first portion 810.

In various exemplary embodiments, as shown in FIG. 12, the second portion 820 of the high capacity ink blotter 800 is positioned in the bottom portion 1030 of the maintenance station 1000. Thus, when the cover portion 1020 is mounted onto the bottom portion 1030, the first portion 810 of the improved capacity ink blotter 800 is securely pressed against the bottom portion 820. This provides a fluid flow path from the first portion 810 to the second portion 820 of the improved capacity ink blotter 800. This is shown in greater detail in FIG. 13.

It should be appreciated that, in various exemplary embodiments, at least the first portion 810 of the improved capacity ink blotter 800 is formed using an ink absorbing material. In particular, in various exemplary embodiments, POREX is used as the ink absorbing material used to form the first portion 810.

After the one or more printheads 12 have been away from the maintenance station 1000 for a specific length of time, the one or more printheads 12 will be moved by, for example, a carriage motor (not shown) under the control of the printer controller 40 to the maintenance station 1000. Once the one or more printheads 12 are placed adjacent to the maintenance station 1000, the wiper blade platform 1025, carrying the one or more wiper blades 30, is moved from the first position to the second position, as described above.

A leading edge portion 822 of the second portion 820 is positioned adjacent to a trailing edge portion 816 of the first portion 810. The second portion 820 is positioned adjacent to and relative to the bottom portion 1030 of the maintenance station 1000 and extends from the trailing edge portion 816 of the first portion 810 down one side of the bottom portion 820 of the maintenance station 1000 and across a portion of a bottom wall 1032 of the bottom portion 1030 of the maintenance station 1000.

In addition, the second portion 820 has an opening 824 that effectively splits the second portion 820 partially down the middle into subportions 826 and 828. The opening 824 in the second portion 820 aids in absorbing and wicking the waste ink through the first portion 816 into the second portion 820 and through to either of the subportions 826 and 828. The additional capillary wicking action of the second portion 820 allows the first portion 810 of the improved capacity ink blotter 800 to drain the waste ink into the second portion 820. This tends to avoid the waste ink from saturating or overfilling the first portion 810 of the improved capacity ink blotter 800. By allowing the waste ink to drain from the first portion 810 of the improved capacity ink blotter 800 into the second portion 820, the chance that any waste ink will spray from the wiper blades 30 as the wiper blades pass over the leading portion 814 of the first portion

810 the first portion 810 of the improved capacity ink blotter 800 is reduced.

While the one or more printer caps 1010 are being purged of ink and the one or more printheads 12 are in the hold position, a paper feed motor may operate the vacuum pump 40 to pump air and ink from the one or more printer caps 1010 into the waste ink accumulator 100. Once the combined ink is in the waste ink accumulator 100, the vacuum pump will continue to draw waste ink from the waste ink accumulator into a separator. The separator may contain the vacuum pump. Alternatively, the vacuum pump may be separate from the separator. Once in the separator, the waste ink is absorbed by a foam member that stores the waste ink. When the vacuum pump is located on the separator, the foam member also prevents ink from entering the vacuum pump. Ink in the pump could damage pump valves.

Optionally, in another exemplary embodiment, where the vacuum pump is separate from the waste ink separator, the combined ink in the waste ink accumulator is drawn into an improved waste ink pad. This improved waste ink pad is described in greater detail in U.S. patent application Ser. No. 09/594,690 filed herewith and incorporated herein by reference in its entirety.

Any time the paper feed motor is turning for any reason other than maintenance, the one or more printheads 12 must be separated from the maintenance station 1000, or at least the one or more printhead caps 600. Otherwise, unwanted ink may be withdrawn from the one or more printheads 12 drawn into the one or more printhead caps 600. This occurs because, when the paper feed motor turns, the vacuum pump operates and continues to pump air through the maintenance station 1000 to purge ink from the one or more printhead caps 600. This tends to further reduce the changes that ink will collect in the tubes 63.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A wiper blade mechanism usable in a maintenance station of an ink jet printer having at least one printhead, comprising:

at least one wiper blade, each wiper blade having a leading edge and trailing edge and being engageable with the at least one printhead so as to remove at least one of ink and debris from the at least one printhead;

a translation actuating mechanism, that drives the at least one wiper blade in between at least first and second positions, the first position being closer to the at least one printhead than the second position;

at least one blotter constructed to direct at least one of the ink and debris towards the first position as the wiper blade is moved from the second position to the first position; and a scraper bar positioned between the first and second positions, such that the leading edge of the at least one wiper blade is biased against the scraper bar as the at least one wiper blade is moved from the first position to the second position, subsequently passes under the scraper bar and returns to a substantially undeformed state, and the trailing edge of the at least one wiper blade is biased against the scraper bar as the at least one wiper blade is moved from the second position to the first, subsequently passes under the scraper bar and returns to a substantially undeformed state, the scraper bar is constructed to direct at least one of the ink and debris towards the at least one blotter subsequent to at least one of the leading edge and the trailing edge returning to an unbiased state.

2. The wiper blade mechanism of claim 1, wherein the scraper bar has a stepped edge and a sloped edge.

3. The wiper blade mechanism of claim 2, wherein the leading edge of the at least one wiper contacts the stepped edge of the scraper bar as the at least one wiper blade is moved from the first position to the second position and the trailing edge of the at least one wiper blade is biased against the scraper bar as the at least one wiper blade is moved from the second position to the first position.

4. The wiper blade mechanism of claim 3, wherein:

the at least one wiper blade is formed of an elastically deformable material;

the at least one elastically deformable wiper blade deforms when the leading edge contacts the stepped edge; and when the leading edge of the at least one elastically deformable wiper blade detaches from the stepped edge, as the at least one elastically deformable wiper blade returns to a substantially undeformed state, ink and debris are removed from the at least one printhead and directed towards the second position.

5. The wiper blade mechanism of claim 4, wherein the at least one wiper blade directs the removed ink and debris towards a spittoon.

6. The wiper blade mechanism of claim 5, wherein the spittoon is formed by a porous material.

7. The wiper blade mechanism of claim 2, wherein the trailing edge of the at least one wiper contacts the sloped edge of the scraper bar as the at least one wiper blade is moved from the second position to the first position and the trailing edge of the at least one wiper blade is biased against the scraper bar as the at least one wiper blade is moved from the first position to the second position.

8. The wiper blade mechanism of claim 7, wherein the sloped edge allows the at least one wiper to easily pass by the scraper bar as the at least one wiper blade is moved from the first position to the second position and the trailing edge of the at least one wiper blade is biased against the scraper bar as the at least one wiper blade is moved from the second position to the first position.

9. The wiper blade mechanism of claim 7, wherein sloped edge reduces an amount of mechanical force required to move the at least one wiper blade past the scraper bar as the at least one wiper blade is moved from the first position to the second position and the trailing edge of the at least one wiper blade is biased against the scraper bar as the at least one wiper blade is moved from the second position to the first position.

10. The wiper blade mechanism of claim 1, further comprising a high capacity blotter.

11. The wiper blade mechanism of claim 1, wherein the translational actuating mechanism includes mechanical amplification provided by a plurality of cams and gears.

12. The wiper blade mechanism of claim 11, wherein the translational actuating mechanism operates in a selectable torque and rotational velocity provided by a drive motor and the desired torque and rotational velocity used with a cam shaft.

13. A wiper blade mechanism usable in a maintenance station of an ink jet printer having at least one printhead, comprising:

at least one wiper blade, each wiper blade having a leading edge and trailing edge;

a translation actuating mechanism, that drives the at least one wiper blade in between at least two positions with a first position being closer to the at least one printhead than a second position;

a scraper bar; and at least one high capacity blotter constructed to direct at least one of the ink and debris towards the first position as the wiper blade is moved from the second position to the first position;

wherein the scraper bar is positioned between the first and second positions, such that the leading edge of the at least one wiper blade is biased against the scraper bar as the at least one wiper blade is moved from the first position disposed at a first portion of the at least one high capacity blotter to the second position, the trailing edge of the at least one wiper blade biased against a leading portion of the first portion of the at least one high capacity blotter and against the scraper bar, subsequently passes under the scraper bar and returns to a substantially undeformed state, as the at least one wiper blade is moved from the second position to the first position the scraper bar is constructed to direct at least one of the ink and debris towards the at least one blotter subsequent to at least one of the leading edge and the trailing edge returning to an unbiased state.

14. The wiper blade mechanism of claim 13, wherein the scraper bar has a stepped edge and a sloped edge.

15. The wiper blade mechanism of claim 14, wherein the leading edge of the at least one wiper contacts the stepped edge of the scraper bar as the at least one wiper blade is moved from the first position to the second position and the trailing edge of the at least one wiper blade is biased against the scraper bar as the at least one wiper blade is moved from the second position to the first position.

16. The wiper blade mechanism of claim 15, wherein:

the at least one wiper blade is formed of an elastically deformable material;

the at least one elastically deformable wiper blade deforms when the leading edge contacts the stepped edge; and when the leading edge of the at least one elastically deformable wiper blade detaches from the stepped edge, as the at least one elastically deformable wiper blade returns to a substantially undeformed state, ink and debris are removed from the at least one printhead and directed towards the second position.

17. The wiper blade mechanism of claim 16, wherein the at least one wiper blade directs the removed ink and debris towards a spittoon.

18. The wiper blade mechanism of claim 17, wherein the spittoon is formed by a porous material.

19. The wiper blade mechanism of claim 14, wherein the trailing edge of the at least one wiper contacts the sloped edge of the scraper bar as the at least one wiper blade is moved from the second position to the first position and the trailing edge of the at least one wiper blade is biased against the scraper bar as the at least one wiper blade is moved from the first position to the second position.

20. The wiper blade mechanism of claim 18, wherein the sloped edge allows the at least one wiper to easily pass by the scraper bar as the at least one wiper blade is moved from the first position to the second position and the trailing edge of the at least one wiper blade is biased against the scraper bar as the at least one wiper blade is moved from the second position to the first position.

21. The wiper blade mechanism of claim 18, wherein sloped edge reduces an amount of mechanical force required to move the at least one wiper blade past the scraper bar as the at least one wiper blade is moved from the first position to the second position and the trailing edge of the at least one wiper blade is biased against the scraper bar as the at least one wiper blade is moved from the second position to the first position.

22. A method of operating a wiper blade mechanism usable in a maintenance station of an ink jet printer having at least one printhead, comprising:

translating at least one wiper blade, each wiper blade having a leading edge and a trailing edge and being engageable with the at least one printhead so as to remove at least one of the ink and debris from the at least one printhead with a translation actuating mechanism, driving the at least one wiper blade in between at least two positions with a first position being closer to the at least one printhead than a second position;

placing a scraper bar between the first and second positions, such that the leading edge of the at least one wiper blade is biased against the scraper bar as the at least one wiper blade is moved from the first position to the second position disposed near at least one high capacity blotter;

biasing the trailing edge of the at least one wiper blade against the scraper bar;

collecting at least one of ink and debris with the at least one high capacity blotter;

directing the at least one of the ink and debris towards at least one blotter subsequent to at least one of the leading edge and the trailing edge passing by the scraper bar and returning the wiper blade to an unbiased state; and utilizing the blotter to direct at least one of the ink and debris towards the first position as the wiper blade is moved from the second position to the first position.

23. The method of claim 22, wherein the operation of the at least one wiper blade further includes contacting a stripped edge of the scraper bar as the at least one wiper blade is moved from the first position to the second position, and contacting a sloped edge of the scraper bar as the at least one wiper blade is moved from the second position to the first position.

24. The method of claim 23, wherein the operation of the at least one wiper blade further includes directing the removed ink and debris towards a spittoon.

25. A method of operating a wiper blade mechanism usable in a maintenance station of an ink jet printer having at least one printhead, comprising:

translating at least one wiper blade, each wiper blade having a leading edge and trailing edge and being engageable with the at least one printhead so as to remove at least one of the ink and debris from the at least one printhead with a translation actuating mechanism, driving the at least one wiper blade in between at least two positions with a first position being closer to the at least one printhead than a second position;

placing a scraper bar between the first and second position, such that the trailing edge of the at least one wiper blade is biased against the scraper bar as the at least one wiper blade is moved from the second position disposed near at least one high capacity blotter to the first position, with the trailing edge of the at least one wiper blade biased against a portion of the at least one high capacity blotter and against the scraper bar, subsequently passes under the scraper bar and returns to a substantially undeformed state, the high capacity blotter removing and directing at least one of the ink and the debris towards the first position, as the at least one wiper blade is moved from the second position to the first position.

26. The method of claim 25, wherein the operation of the at least one wiper blade further includes contacting a stripped edge of the scraper bar as the at least one wiper blade is moved from the first position to the second position, and contacting a sloped edge of the scraper bar as the at least one wiper blade is moved from the second position to the first position.

27. The method of claim 26, wherein the operation of the at least one wiper blade further includes directing the removed ink and debris towards a spittoon.

* * * * *